US009737917B2

(12) United States Patent
Booth et al.

(10) Patent No.: US 9,737,917 B2
(45) Date of Patent: Aug. 22, 2017

(54) METHOD AND APPARATUS FOR NAVIGATING LONGITUDINAL BORES

(71) Applicants: Campbell Alan Booth, Dunedin (NZ); Gary Alan Gibson, Dunedin (NZ); Patrick David Maguire, Dunedin (NZ)

(72) Inventors: Campbell Alan Booth, Dunedin (NZ); Gary Alan Gibson, Dunedin (NZ); Patrick David Maguire, Dunedin (NZ)

(73) Assignee: Paul James Fricker (NZ)

( * ) Notice: Subject to any disclaimer, the term of this patent is extended or adjusted under 35 U.S.C. 154(b) by 528 days.

(21) Appl. No.: 14/360,641

(22) PCT Filed: Nov. 26, 2012

(86) PCT No.: PCT/NZ2012/000216
§ 371 (c)(1),
(2) Date: May 26, 2014

(87) PCT Pub. No.: WO2013/077750
PCT Pub. Date: May 30, 2013

(65) Prior Publication Data

US 2015/0041165 A1 Feb. 12, 2015

(30) Foreign Application Priority Data

Nov. 25, 2011 (NZ) ..... 596689

(51) Int. Cl.
*E03C 1/304* (2006.01)
*B08B 9/04* (2006.01)
(Continued)

(52) U.S. Cl.
CPC ..... *B08B 9/04* (2013.01); *B08B 9/027* (2013.01); *B08B 9/0321* (2013.01);
(Continued)

(58) Field of Classification Search
CPC .. B01J 8/06; B01J 8/0015; B08B 9/00; B08B 9/02; B08B 9/0327; B08B 9/027; B08B 9/0321; B08B 9/0322; B08B 9/04; B08B 9/043; B08B 9/0433; B08B 9/053; E03D 9/00; E03C 1/306; E03C 1/308; E03C 1/12; E03C 1/304; E03F 9/00
USPC ..... 173/168, 169, 1, 29, 170; 4/255.01–255.12; 134/91, 146, 166 C, 134/167 C, 167 R, 166 R, 168 C, 169 R, 134/172, 182, 198; 285/8, 107, 109; 15/345, 304, 406, 104.33; 141/7, 65
See application file for complete search history.

(56) References Cited

U.S. PATENT DOCUMENTS 2,315,673 A * 4/1943 Taylor ..... E03C 1/306 4/255.01
3,075,535 A * 1/1963 Lasting ..... B08B 9/0322 134/167 C
(Continued)

*Primary Examiner* — Scott A. Smith
(74) *Attorney, Agent, or Firm* — Janeway Patent Law PLLC

(57) ABSTRACT

An apparatus for accessing longitudinal bores which includes: a length of resilient tube configured to be extendible along at least a portion of its length; wherein one end of the resilient tube includes a utility head thereon; and wherein the other end of the tube is configured to directly or indirectly connect to, and receive a force from, a physical energy source.

17 Claims, 9 Drawing Sheets

(51) Int. Cl.

| | |
|---|---|
| ***B08B 9/027*** | (2006.01) |
| ***E03C 1/306*** | (2006.01) |
| ***E03F 9/00*** | (2006.01) |
| *B08B 9/032* | (2006.01) |
| *B08B 9/053* | (2006.01) |
| *B08B 9/043* | (2006.01) |

(52) U.S. Cl.
CPC ..... *B08B 9/0433* (2013.01); *E03C 1/304* (2013.01); *E03C 1/306* (2013.01); *E03F 9/00* (2013.01); *B08B 9/0322* (2013.01); *B08B 9/043* (2013.01); *B08B 9/053* (2013.01)

(56) References Cited

U.S. PATENT DOCUMENTS 4,552,515 A * 11/1985 Endo ..... B67D 7/0205 137/147
4,756,480 A * 7/1988 Fish ..... E03C 1/306 16/DIG. 24
4,957,123 A * 9/1990 McHugh ..... B08B 9/0322 134/167 C
5,253,664 A 10/1993 Wilson
5,329,646 A 7/1994 Bevacco
5,546,613 A * 8/1996 Davenport ..... B08B 9/0322 4/255.05
5,735,016 A * 4/1998 Allen ..... B08B 9/047 134/113
5,996,159 A * 12/1999 Irwin ..... B08B 9/045 134/113
6,111,600 A * 8/2000 McLeod ..... B08B 9/0495 348/84
6,686,950 B1 2/2004 Caffon
6,813,810 B2 * 11/2004 Beynon ..... A47L 7/02 15/304
6,907,622 B2 * 6/2005 Rasaei ..... E03D 9/00 4/255.04
6,941,589 B1 * 9/2005 Dural ..... B08B 9/032 4/255.01
7,063,095 B2 * 6/2006 Barcay ..... B08B 9/00 134/166 R
7,340,783 B2 * 3/2008 Leaphart, Jr. ..... E03C 1/308 4/255.02
7,530,122 B2 * 5/2009 Schaaf ..... E03C 1/30 138/90
8,312,572 B2 * 11/2012 Heffner ..... E03D 9/00 4/255.01
8,745,771 B2 * 6/2014 Bates ..... E03C 1/304 4/255.04
8,760,507 B2 * 6/2014 Boehnlein ..... G01N 21/954 348/65
2005/0050624 A1 * 3/2005 Pangramuyen ..... E03C 1/308 4/255.01

* cited by examiner

METHOD AND APPARATUS FOR NAVIGATING LONGITUDINAL BORES

STATEMENT OF CORRESPONDING APPLICATIONS

This application is based on the Provisional specification filed in relation to New Zealand Patent Application Number 596689, the entire contents of which are incorporated herein by reference.

TECHNICAL FIELD

The present invention relates to improvements in and relating to methods and apparatus for navigating longitudinal bores. The present invention has particular advantage in navigating pipes which define a convoluted path or which include one or more corners or bends.

BACKGROUND ART

The present invention relates to a method and apparatus for navigating and clearing blockages in pipes and tubes.

For the purposes of clarity only, the background to the present invention will now be provided in terms of household pipes. However, it will be appreciated the invention may have application in the navigation of, and in some embodiments clearing of blockages from, any number of pipe or tube like constructions. For example, the present invention may have application to navigating: exhaust pipes, drains, rainwater down pipes, air-conditioning pipe systems or the like.

Blocked household pipes and drains are a fact of life; typically household blockages occur in the water outlet pipes. The main reason such blockages arise is due to the fact that rain water and household waste water typically carry additional matter which can become stuck in the drainage pipes. Over the years numerous devices have been created to clear, or free, blockages from pipes. Preferably, a blockage is cleared remotely from the point of the blockage by applying and releasing pressure to and from the pipe, thereby breaking up the blockage. Typically a plunger is used for this purpose. However, particularly stubborn blockages, or blockages which are remote from a pipe's access point, cannot be easily removed via a plunger and require a more directly applied force to effect physical removal.

Physical removal can be a particularly disruptive, unpleasant, and expensive job as the blocked pipe may need to be dug up, wall or floor panels removed and the blocked portion cut open to remove the blockage.

One method for applying a more direct force typically involves pushing a flexible non-compressible elongate device down the pipe. Once the end of the elongate device hits the blockage pressure can be applied directly to break up, or hook, the blockage. One commonly used type of elongate device is a standard garden hose. A garden hose has the further advantage of being able to apply a jet of water at the site of the blockage further improving the ability to free the blockage.

One problem with using a hose or piece of wire to apply a more direct force to the blockage is that the hose/wire may not readily go around corners in a pipe system. In particular pipe corner joints that are 90 degree bends do not normally permit a hose to navigate its way around the bend—much to the frustration of the person seeking to remove the blockage.

In some cases an Electric Eel™ drainage clearing apparatus can be used. This device either includes a drum of cable or requires a number of interconnecting spring steel sections and geared motors which rotate the drum and cable or spring steel sections. In cable versions the cable and an attached head flail about inside the pipe, hopefully clearing any blockage in the process. Where spring steel sections are used the sections form a drive shaft for driving a cutting head Needless to say these machines are relatively specialized and expensive and require some know how to operate. If an Electric Eel™ drainage clearing apparatus encounters a difficult to navigate corner in a pipe, the motor can be engaged and the flailing head may be more easily pushed around the corner.

Another method uses a hydro jet cutter, which forces water at high pressure through flexible hoses. The hose is flexible enough to negotiate bends and is pushed down a pipe until an obstruction is reached. The blockage is cleared by direct pressure from the water jet. These devices are expensive as very high pressures are involved, requiring the use of a specialist hose. A disadvantage is that the hose is difficult to force around sharp bends. Furthermore, as pressure is applied the water jet can push the hose back down the pipe away from the blockage, reducing the effectiveness of the clearing action of the jet on the blockage.

It would therefore be useful if there was a less expensive, less complicated apparatus for accessing pipe systems and the like which could be easily used and/or owned by the average homeowner.

It is an object of the present invention to address the foregoing problems or at least to provide the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Further aspects and advantages of the present invention will become apparent from the ensuing description which is given by way of example only.

DISCLOSURE OF THE INVENTION

This specification details a system for navigating, and if required, clearing blocked longitudinal bores such as, but not limited to, drains and the like. The present invention includes, at its leading end, at least a portion which is capable of extending in length when fluid pressure is applied to the apparatus. When inserted into a pipeline both the present invention and the prior art will become jammed when a sharp corner or blockage is encountered. By applying fluid pressure to the apparatus of the present invention at least a portion extends in length and thereby applies a force substantially at or near the corner or blockage. This results in a foremost utility head of the apparatus being pushed around the encountered corner or into the blockage According to one aspect of the present invention there is provided an apparatus for accessing longitudinal bores which includes:

a length of corrugated elastomeric tube which can exist in either an extended (stretched) state or a non-extended (resting) state;

wherein one end of the tube has a utility head thereon;

wherein the other end of the tube is configured to be connected to a physical energy source which can apply a force to the tube causing the tube to extend in length whilst the force is applied, and wherein the length of the tube retracts to the non-extended state when the force ceases to be applied.

According to one aspect of the present invention there is provided an apparatus for accessing longitudinal bores which includes:

a length of resilient tube configured to be extendible along at least a portion of its length;

wherein one end of the resilient tube includes a utility head thereon;

wherein the other end of the tube is configured to directly or indirectly connect to, and receive a force from, a physical energy source.

Preferably application of force to the resilient tube, by the physical energy source, results in extension of the at least a portion of the resilient tube.

Preferably the force applied by the physical energy source can be selectively applied and removed.

Preferably the resilient tube can exist in an extended (stretched) state when force is applied and a non-extended (resting) state when the force is absent.

Preferably the portion of resilient tube configured to be extendible is, or includes, a portion of corrugated elastomeric tube.

In preferred embodiments the apparatus includes a control device which enables an operator to control when the force is applied to the length of tube and when it is removed.

In preferred embodiments the longitudinal bore is a pipe system, however it will be appreciated that the apparatus has application in accessing any elongate tubular network and therefore it should not be seen as being limited to pipe systems.

In preferred embodiments the resilient tube is configured to be connected to the physical energy source by way of a hose fitting.

It will be understood that in the context of the present invention the length of resilient tube used by the apparatus is not limited to a particular length.

In some embodiments the length of resilient tube used includes a relatively short portion that is configured to be inserted into a pipe. In such embodiments a hose may be attached to the resilient tube, providing connection between the physical energy source and the resilient tube, the hose also being able to be inserted into the pipe to push the length of resilient tube into the pipe to a greater depth, the insertion depth of the resilient tube only being limited by the length of the hose.

It will be appreciated that the percentage that the resilient tube is able to lengthen over its non-extended state is a determining factor in the length of the resilient tube for a particular apparatus for accessing longitudinal bores. For example, if a 30 cm extension is desired and the resilient tube used is capable of 30% extension under pressure, the length of resilient tube would need to be a minimum of 1 m long.

In one preferred embodiment the length of resilient tube may be substantially 5 m long. In a further preferred embodiment the length of resilient tube may be greater than 10 m long.

In preferred embodiments the apparatus is substantially tubular.

In preferred embodiments at least a portion of the length of resilient tube is flexible at pipe pressure.

It will be appreciated by a person skilled in the art that pipe pressure refers to a point of equilibrium between the pressure inside the length of resilient tube and the pressure in the pipe into which the length of resilient tube is inserted.

In preferred embodiments the length of resilient tube may become substantially rigid when force is applied thereto by the physical energy source.

In all embodiments the length of resilient tube becomes further elongated when increasing force is applied by the physical energy source until the resilient tube is in its fully extended state.

It will be appreciated by persons skilled in the art that the force necessary to elongate and/or rigidify the length of resilient tube will depend upon the type of material the length of resilient tube is constructed from. For example, a particularly flexible material may require substantially more pressure to achieve the same level of rigidity as a material that is less flexible. Equally a less extensible resilient tube may require significantly more force to achieve the same level of elongation as a more extensible tube.

In preferred embodiments the utility head may be configured to more easily slide along the walls of a pipe. Non limiting examples of such easily slid utility heads include:

a ball head;

a head including slide portions;

a head including a wheel or wheels; and a head including one or more water jet outlets directed outward towards the sides of the tube.

The utility head may be configured to aid in the unblocking of a pipe. Non limiting examples of utility head features configured to help unblock pipes include:

one or more forward facing water jet outlets;

one or more abutting portions configured to butt up against a blockage; and one or more telescoping protrusions for penetrating a blockage.

In some preferred embodiments the utility head may include one or more attachments, such as, but not limited to:

cutting blades;

camera(s); and manipulators such as fingers.

In some preferred embodiments different pressures may be used to activate different water jets. For example:

a low pressure may result in substantial extension of at least the extensible member;

a medium pressure may result in further extension and/or activation of one or more head mounted water jet outlets directed outward towards the sides of the tube, thereby aiding slidebility; and a high pressure may result in full extension and/or disabling the side water jets and/or activation of a forward facing blockage clearing water jet.

In preferred embodiments application of force to the resilient tube results in substantially longitudinal extension of the resilient tube with little or no cross-sectional expansion.

In especially preferred embodiments the resilient tube is a polypropylene blow molded corrugated hose.

In use the resilient tube extends in length without any substantial cross-sectional expansion. It will be appreciated that under equilibrium conditions a corrugated resilient tube has a defined length and sidewall sections which alternate between greater and smaller diameter, the sidewall sections are formed together as a homogonous pipe structure. When the internal pressure of the corrugated pipe exceeds the external pressure, the spacing between the greater and smaller diameter sections increases, thereby resulting in an overall extension of the tube. As the resilient tube increases in length the corrugations formed by the larger and smaller diameter sections flatten.

In preferred embodiments the physical energy source may take any number of forms without departing from the scope of the invention and therefore should not be seen as being limiting. Non limiting examples include:

a household water supply;

the fluid output of a compressor;

the output of a water blaster or the like; and a reciprocating machine which imparts a vibrational frequency to the tube.

In preferred embodiments the force supplied to the apparatus may be turned on and off by way of a tap.

In other preferred embodiments the force supplied to the resilient tube may be turned on and off by way of a manually activated valve, such as a foot switch or a hand held trigger.

In preferred embodiments the fluid supplied to the apparatus may be turned on and off by way of an electronic circuit controlling a solenoid valve.

In preferred embodiments the electronic circuit switches the solenoid valve on and off repeatedly.

In especially preferred embodiments the force is supplied to the resilient tube as a pressurised fluid. Most preferably the fluid is water.

In some preferred embodiments the pressurised fluid may be applied to the resilient tube at a range of different pressures.

In some preferred embodiments the pressurised fluid may be varied by way of a variable pressure valve.

In preferred embodiments the resilient tube reverts to substantially the same pressure as a surrounding pipe by way of the internal pressure of the apparatus feeding to the outside of the resilient tube by way of an aperture in the resilient tube and/or utility head attached thereto.

In preferred embodiments the aperture is located in the utility head.

In preferred embodiments the aperture in the utility head acts as a water jet when the pressurised fluid supply is turned on.

According to a further aspect of the present invention there is provided a conveyance device which includes:

a handle portion having a trigger;

an outlet port;

an inlet port wherein the handle is configured to support a fixed length of hose and/or a length of resilient tube which can be fed out from the handle or can be retrieved back towards the handle; and wherein operation of the trigger operates a valve positioned between the inlet port and the outlet port to move from an open to a closed position, or vice versa; and wherein the outlet port is in fluid communication with the hose and/or length of resilient tube; and wherein the inlet port is configured to be attached to a pressurised fluid supply.

In preferred embodiments the system may be used for navigating pipes.

In preferred embodiments the handle portion may be configured to allow a person's hand to simultaneously grip both the handle and a portion of the length of hose or resilient tube being fed out or retrieved.

According to a further aspect of the present invention there is provided a method of accessing longitudinal bores with an apparatus including a length of corrugated elastomeric resilient tube having a utility head at one end and being connected to a physical energy source at the other end which can apply a force to the resilient tube causing the resilient tube to extend in length whilst the force is applied, and wherein the length of the resilient tube retracts when the force ceases to be applied, the method including the steps of:

a) manually feeding the resilient tube into a pipe system;

b) when the resilient tube encounters an obstacle, applying a force to the resilient tube by way of the physical energy source whilst maintaining manual feeding pressure, and then releasing said force; and c) if necessary, repeating the application and release of the force on the resilient tube until the said obstacle has been overcome.

Preferably, the resilient tube is inserted into the pipe system to find a blockage or other region(s) of interest.

Preferably the method substantially as described above includes the additional step of:

d) applying force by way of the physical energy source to elongate the hose and make the hose rigid so it can be driven into a blockage.

Preferably the method substantially as described above includes the additional step of:

e) intermittently interrupting the supply of pressurised fluid to the hose so the hose repeatedly moves between a rigid stretched and flexible relaxed state and thereby acts like a hydraulic piston.

The present invention may provide a number of advantages over the prior art, including, but not being limited to:

providing a system which may relatively easily navigate a pipe system having a number of corners;

providing a system whereby a force may be applied at a distal end of a pipe cleaning system so as to overcome an obstacle such as a corner or blockage in the said pipe system;

providing a system which may be easily transported to and from a blocked pipeline;

providing a system whereby a combination of direct impacting and/or application of a water jet may be used to breakup or otherwise free a blockage; and/or providing an apparatus that may be easily fitted to the end of an existing hose to aid in the clearing of a blocked pipeline.

BRIEF DESCRIPTION OF THE DRAWINGS

Further aspects of the present invention will become apparent from the ensuing description which is given by way of example only and with reference to the accompanying drawings in which.

BEST MODES FOR CARRYING OUT THE INVENTION

Figure 1:
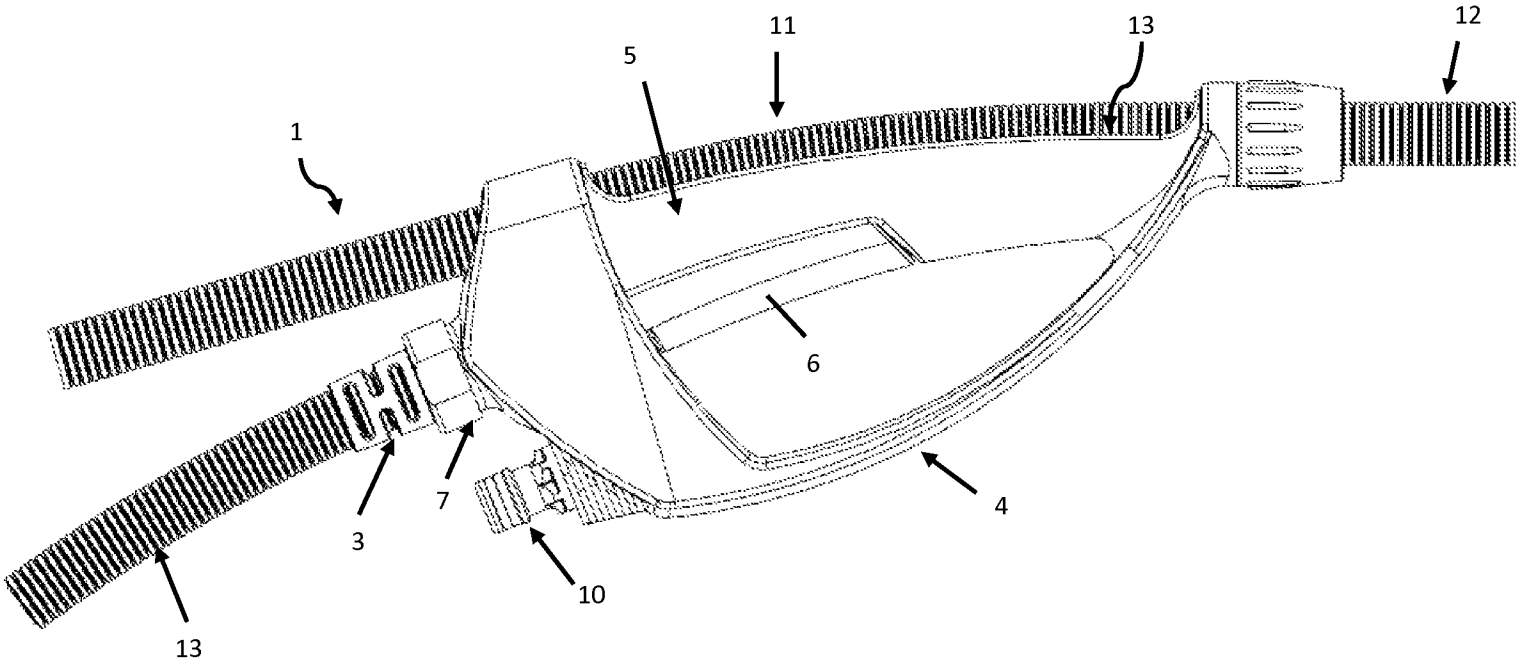
FIG. 1 shows a profile view of a system for navigating pipes in accordance with one preferred embodiment of the present invention.
Figure 2:
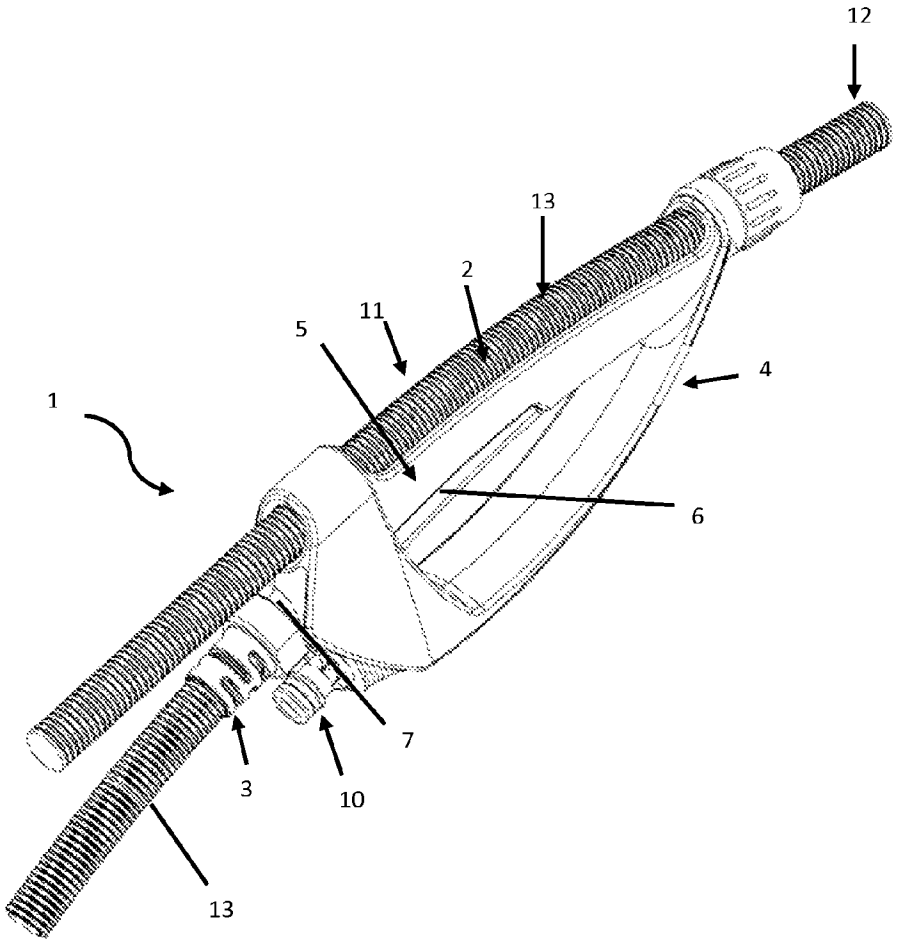
FIG. 2 shows an isometric view of the system shown in FIG. 1.
Figure 3:
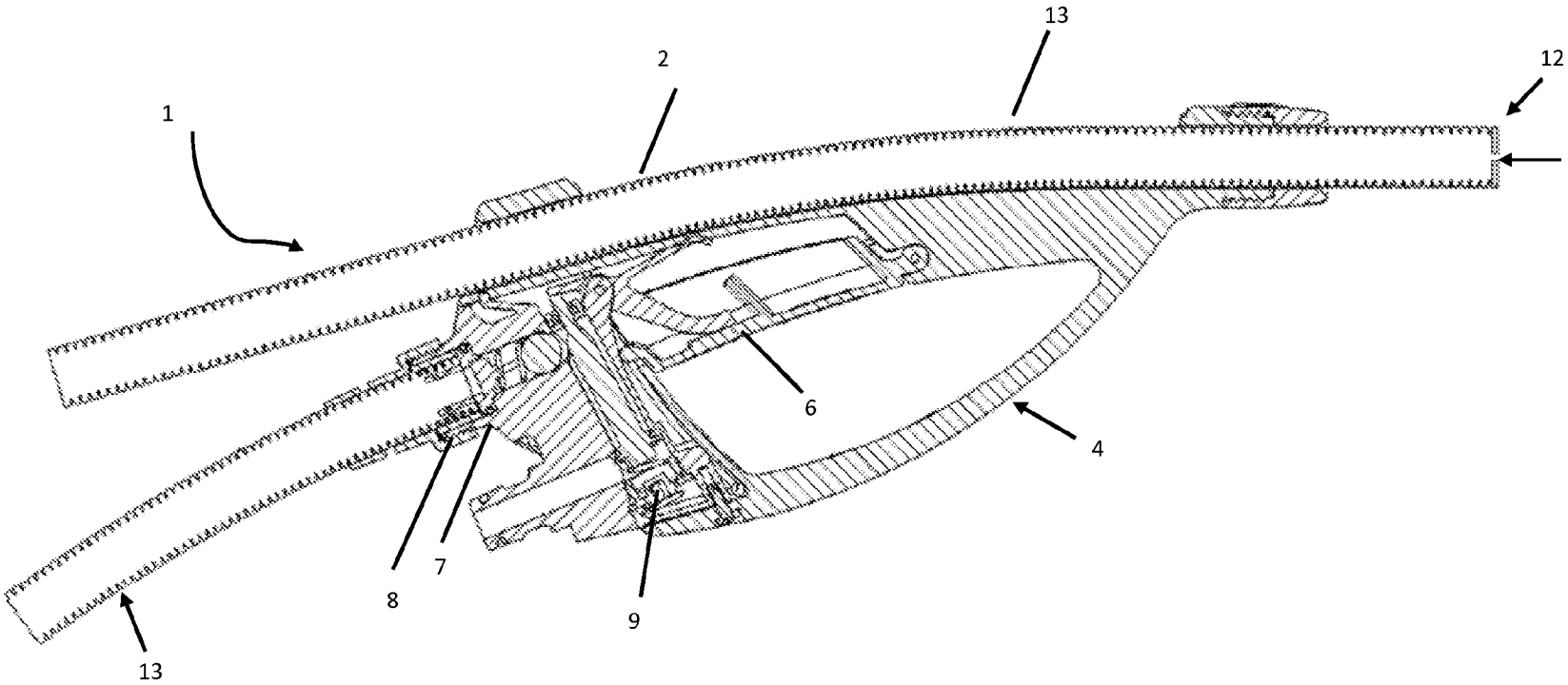
FIG. 3 shows a cross-sectional view of the system shown in FIG. 1.

With respect to FIGS. 1-3 there is shown an apparatus for accessing longitudinal bores (not shown) as generally indicated by arrow 1. The system 1 includes a length of blow molded corrugated resilient tube 13. For clarity the corrugated resilient tube 13 is not shown in full length, but should be understood to loop at the left end of FIG. 1. The resilient tube 13 is configured to attach at one end to a physical energy source in the form of a pressurized water supply (not shown) by way of hose fitting 3. The other end of resilient tube 13 includes a utility head 12 in the form of a capped hose end with an aperture 12*a* there through. Aperture 12*a* allows the corrugated resilient tube to depressurise to an un-stretched rest state when no pressure is applied or to emit a forward direct jet of fluid when pressurised.

The apparatus of FIGS. 1-3 is attached to conveyance device 4 at outlet port 7.

Conveyance device 4 includes a handle portion 5 having a trigger 6. The trigger 6 activates valve assembly 9, shown in FIG. 3. In use, the valve assembly 9 allows force in the form of a pressurized fluid from the water supply to flow from the conveyance device 4 inlet port 10 to outlet port 7 and therefore into resilient tube 13.

Whilst not shown in the Figures, it will be appreciated that inlet port 10 is configured for attachment to one end of a hose (not shown) wherein the other end of the hose is connected to a pressurised fluid generated by a physical energy source (not shown).

The handle portion 5 is configured to allow a person's hand (not shown) to simultaneously grip both the handle 5 and, as generally indicated by arrow 11, a portion of the resilient tube 13. It will be appreciated that the length of resilient tube 13 that can be fed out and retrieved is dictated by the length of corrugated resilient tube 13 available. In some embodiments (not shown) a substantially non-extensible hose is connected between the corrugated resilient tube 13 and the outlet port 7 of the conveyance device 4.

Figure 4A:
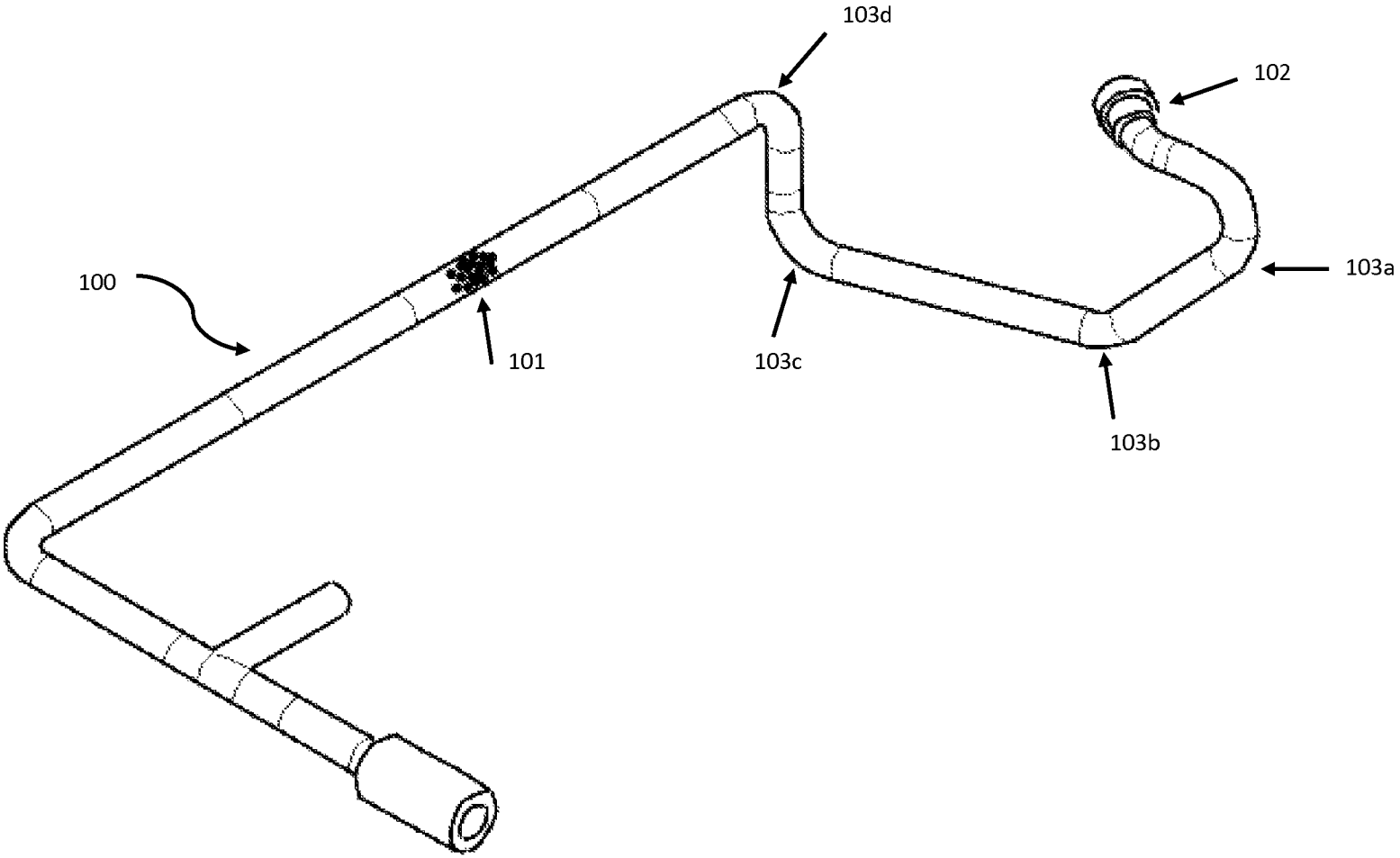
FIG. 4*a* shows a pipeline including a blockage.
Figure 4B:
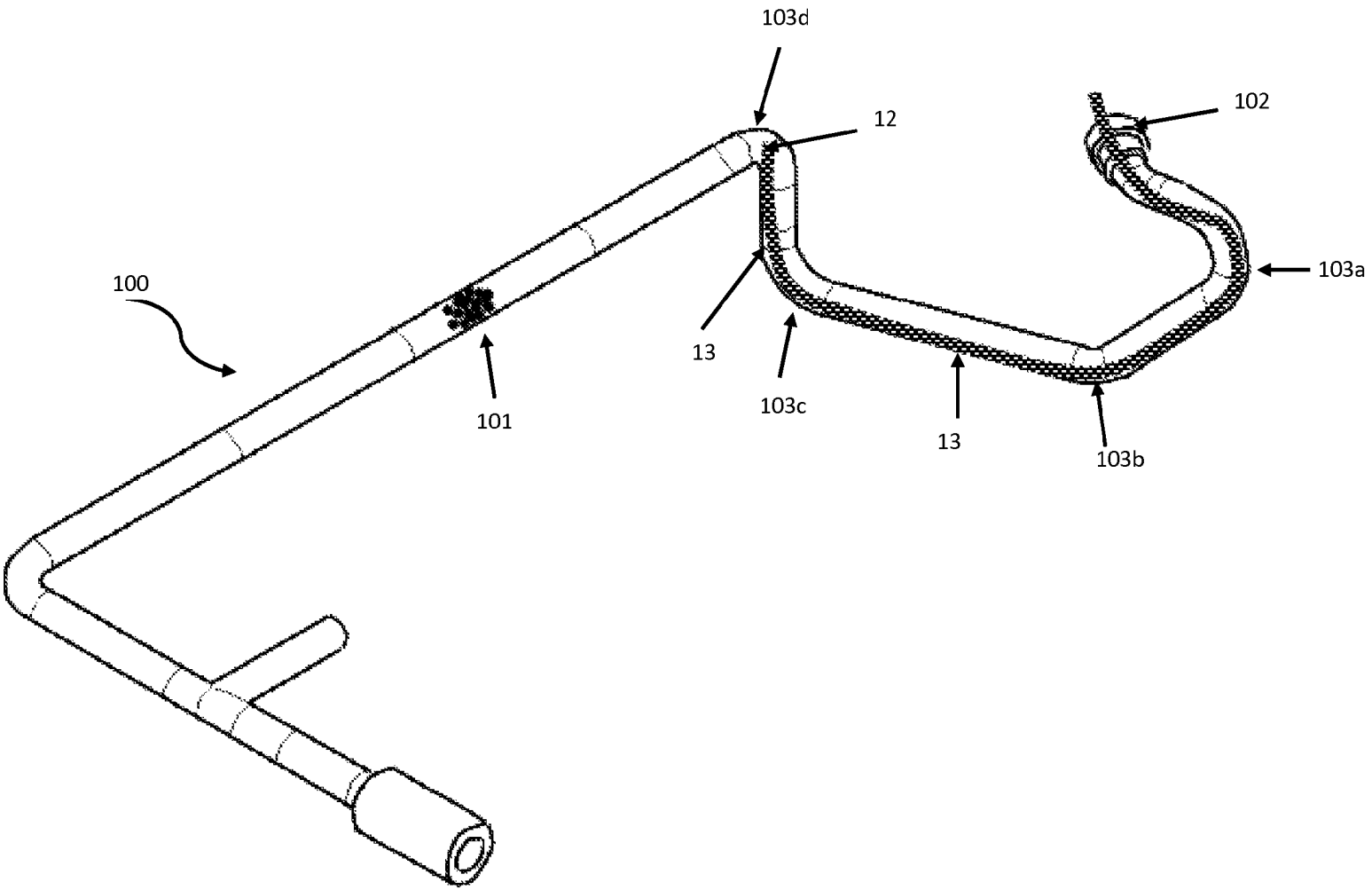
FIG. 4*b* shows the pipeline of FIG. 4 with the system of FIG. 1.
Figure 4C:
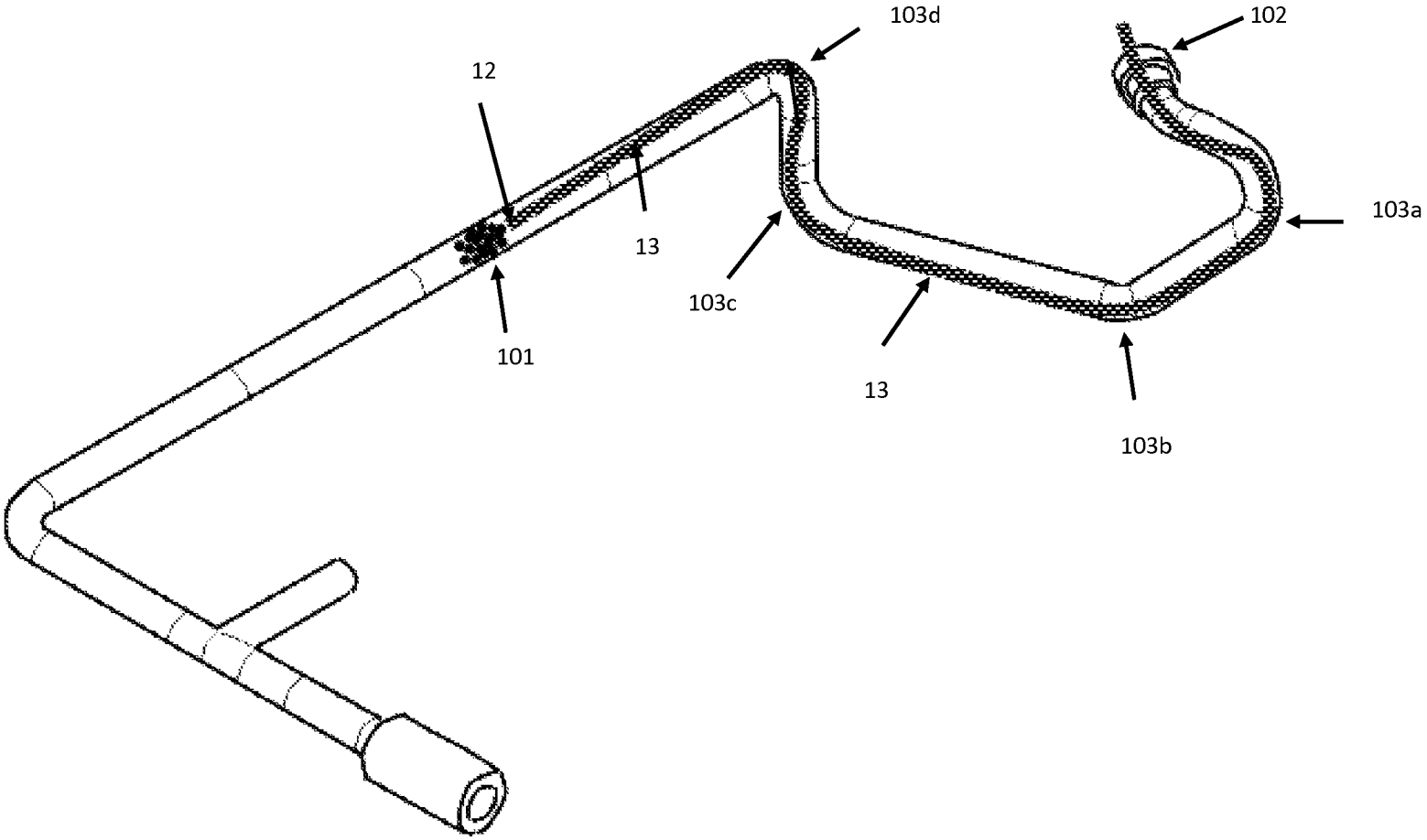
FIG. 4*c* shows the pipeline of FIG. 4 with the system of FIG. 1.
Figure 5A:
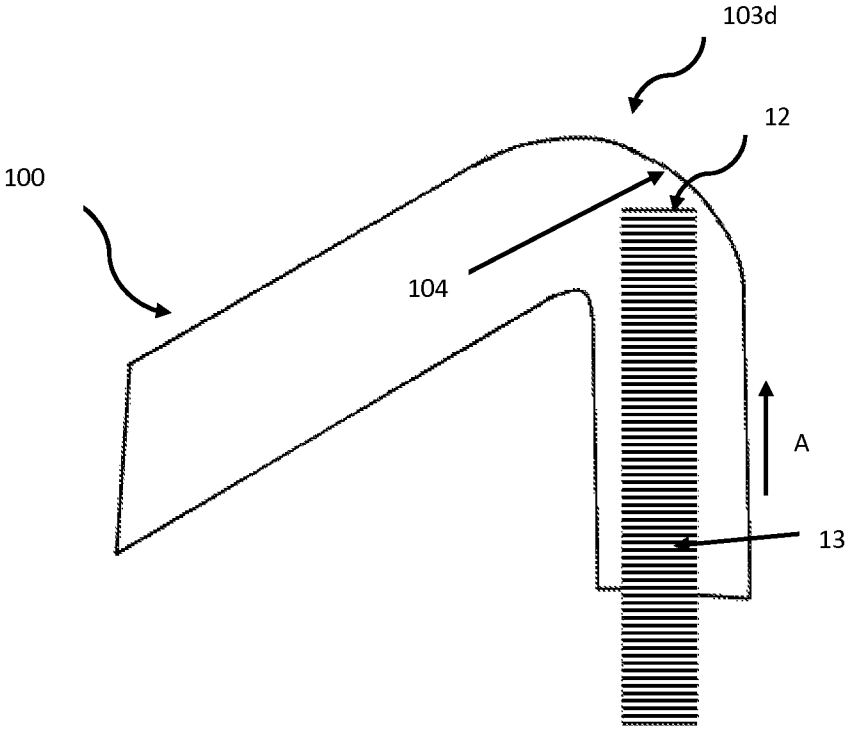
FIG. 5*a* shows a detail view of a section of the pipeline and system shown in FIG. 4*b;*

The use of the apparatus for accessing a longitudinal bore is now described by way of example. In this regard a pipeline 100 is shown in FIGS. 4*a*-4*c*. Access to the pipeline 100 is available at first end 102. The pipeline 100 includes a blockage 101 which is separated from access point 100 by a number of corners 103*a*, 103*b*, 103*c* and 103*d*. Traditional means of pushing a flexible material such as a hose down the pipe may, with persistence, be able to navigate bends 103*a* and 103*b* due to their large radii. However bends 103*c* and 103*d* are unlikely to be easily navigated by the hose. The reason for this is evident in FIGS. 4*b* and 5*a*, which shows the utility head 12 and a portion of the corrugated resilient tube 13 inside the pipeline 100. In FIGS. 4*b* and 5*a* the corrugated resilient tube 13 is in its non pressurized unstretched state. It will be appreciated that further application of longitudinal force A will result in the hose maintaining its straight trajectory and hitting the pipe wall at point 104. Because the corrugated resilient tube 13, or a regular hose for that matter, requires a degree of resiliency in order to be pushed into the pipeline 100 it is likely to become stuck as the relatively short portion that extends across the corner is not flexible enough to bend around the corner without a substantial force being applied. This issue is further exacerbated by the previous corners 103*a*, 103*b* and 103*c* each of which reduce the force that can be applied to push the corrugated resilient tube 13 utility head 12 around corner 103*d*. This problem is not solved by using a more flexible resilient tube as instead of sliding along the pipeline a highly flexible resilient tube would simply concertina or bunch up on itself.

Figure 5B:
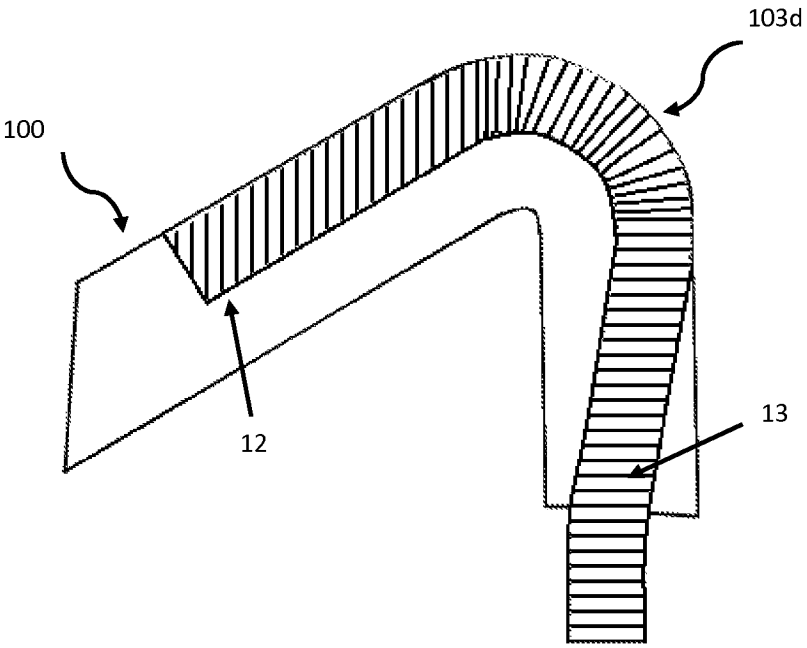
FIG. 5*b* shows a detail view of a section of the pipeline and system shown in FIG. 4*b;*

FIG. 5*b* shows the corrugated resilient tube 13 of FIG. 5*a* once a pressurised fluid source is applied to the resilient tube 13. In the embodiment of FIGS. 1-3 the pressurised fluid source is applied by way of pulling trigger 6. Prior to pulling trigger 6 the corrugated resilient tube 13 is manually fed into the pipe system 100 until an obstruction is felt, the pipe is then held in place at the pipe entry 102 by the operator (not shown). As the corrugated resilient tube 13 extends under pressure it tends to jam itself in the pipeline 100, particularly at any corners 103*a*, 103*b*, 103*c*. Because the resilient tube 13 is held in place at the pipe entry 102 by the operator, the end 12 receives a large proportion of the pressure induced extension force. The extension force acts to drive at least the utility head 12 and a portion of the corrugated resilient tube 13 around the corner 103*d*. Further feeding force by the operator as the pressurised fluid source is disconnected results in the corrugated resilient tube being able to be fed around the corner 103*d*. As the pressurised fluid source is disconnected fluid pressure is lost through an aperture 12*a* in the end of the utility head 12 until the resilient tube 13 internal pressure reaches equilibrium with the pipe 100 pressure.

FIG. 4*c* shows the pipeline 100 with a resilient tube length of resilient tube 2 inserted to the point whereby the blockage 101 has been reached by the utility head 12. If simply pushing more of the resilient tube 2 into the pipeline 100 fails to dislodge the blockage 101, the user can connect the pressurised fluid (not shown) to the resilient tube 13 by pulling trigger 6. This application of pressure results in the utility head 12 extending forward and butting against the blockage 101. At the same time a jet of water sprays from aperture 12*a* in the end of the utility head 12. This jet of water assists in breaking up and freeing the blockage.

By pulling the trigger on and off, the utility head 12 effectively batters the blockage until it becomes dislodged. In some systems an electronic controller may be used which electronically controls connection of the pressurised fluid by way of a solenoid valve. Such embodiments will provide a number of settings, such as extend, retract and pulse. In the pulse mode the resilient tube 13 repeatedly lengthens and relaxes in a pulsing or vibrating motion.

Figure 6A:
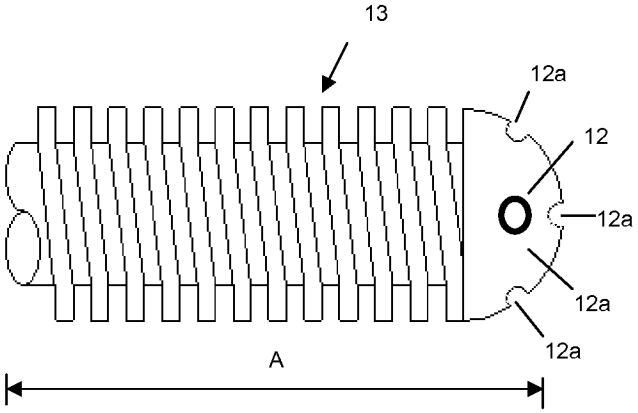
FIG. 6*a* shows a length of non-pressurized corrugated resilient tube in accordance with one preferred embodiment of the present invention.
Figure 6B:
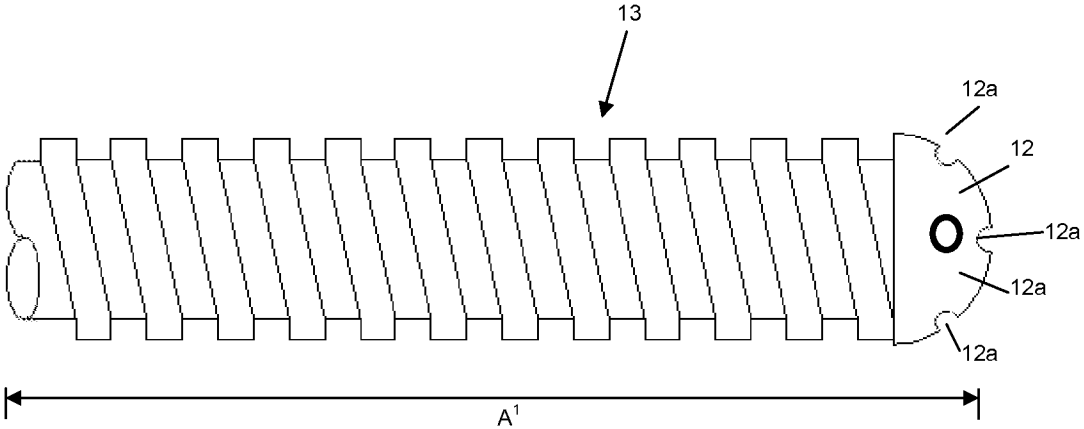
FIG. 6*b* shows the length of corrugated resilient tube shown in FIG. 6*a* under pressure.

FIGS. 6*a* and 6*b* illustrate the elongation and retraction of a section of corrugated resilient tube 13 upon the application and removal of internal fluid pressure. In FIG. 6*a* the length of corrugated resilient tube 13 has an equal internal and external fluid pressure and the corrugated resilient tube 13 takes its natural unstretched form having length A. In FIG. 6*b* the length of corrugated resilient tube 13 has an internal pressure substantially higher than the external pressure, the higher internal pressure causes the corrugated resilient tube 13 to stretch and elongate to length A'. At the same time the internal fluid pressure forces jets of fluid (not shown) out of apertures 12*a*. The jets of fluid aid in clearing blockages and also allow the internal corrugated resilient tube 13 pressure to return to equilibrium once the pressurized fluid source is disconnected. Once the internal fluid pressure has fallen to below the pressure required to elongate the corrugated tube, the corrugated resilient tube returns to its natural unstretched form having length A.

Aspects of the present invention have been described by way of example only and it should be appreciated that modifications and additions may be made thereto without departing from the scope thereof.

What I claim is:

1. An apparatus for navigating a pipe having one or more bends and/or accessing and clearing a blockage in a pipe, the apparatus comprising:

a length of resilient tube comprising a first end and a second end wherein the first end of the resilient tube comprises a utility head comprising at least one aperture therein;

a supporting body configured to support at least a portion of the length of the resilient tube and comprising: a handle; an inlet port; an outlet port; and a valve located between the inlet port and the outlet port;

wherein the outlet port is connected to the second end of the resilient tube and the inlet port is connectable to a pressurized fluid supply;

wherein the supporting body also comprises a control device configured to open the valve to allow pressurized fluid from the fluid supply to flow through the resilient tube and out the aperture in the utility head, and to close the valve to prevent fluid flow to the utility head; and wherein at least a portion of the resilient tube is configured to automatically extend in length under force of the pressurized fluid as the pressurized fluid flows through the resilient tube, and to return to a substantially non-extended, resting state when the pressurized fluid is prevented from flowing through the resilient tube.

2. The apparatus of claim 1, wherein the supporting body comprises a tube supporting region within which a portion of the resilient tube is held and along which the resilient tube may be moved to allow the resilient tube to be fed out from the supporting body and to be retrieved respectively.

3. The apparatus of claim 1, wherein the extendible length of the resilient tube comprises a corrugated elastomeric tube.

4. The apparatus of claim 1 wherein the utility head is configured to produce a fluid jet when pressurized fluid is supplied to the utility head.

5. The apparatus of claim 4, wherein the pressurized fluid to be supplied to the utility head is water.

6. The apparatus of claim 1, wherein the control device comprises a trigger that is configured to open and close the valve by squeezing and releasing the trigger.

7. A method of accessing and clearing a blockage in a pipe, the method comprising the steps of:

a) providing the apparatus of claim 1 and feeding the first end of the resilient tube into a pipe until the utility head encounters the blockage;

b) maintaining the supported portion of the resilient tube in position with respect to the supporting body; and c) activating the control device to allow pressurized fluid to flow through the at least one aperture in the utility head as a fluid jet and to cause at least a portion of the resilient tube to extend in length under force of the pressurized fluid and butt against the blockage.

8. The method of claim 7, wherein the pressurized fluid flowing through the resilient tube is of a sufficient pressure to cause the resilient tube to become substantially rigid so that the utility head can be driven into a blockage.

9. The method of claim 8, wherein the pressurized fluid is provided at a sufficient pressure to cause the utility head to butt against the blockage in a ramming motion.

10. The method of claim 7, wherein the pressurized fluid flowing through the resilient tube is of a sufficient pressure to create a fluid jet as the fluid exits the at least one aperture of the utility head.

11. The method of claim 7, wherein the pressurized fluid supplied to the utility head is water.

12. The method of claim 7 further comprising deactivating the control device to prevent fluid flow to the utility head and to cause the extended portion of the resilient tube to retract to a substantially non-extended, resting state.

13. The method of claim 12 further comprising repeating the activation and deactivation of the control device to cause the utility head to repeatedly butt against the blockage as the resilient tube extends and substantially retracts until the blockage is cleared.

14. A method for navigating a pipe having one or more bends, the method comprising the steps of:

a) providing the apparatus of claim 1 and feeding the first end of the resilient tube into a pipe such that a portion of the resilient tube extends past a bend in the pipe;

b) maintaining the supported portion of the resilient tube in position with respect to the supporting body;

c) activating the control device to allow pressurized fluid to flow through the at least one aperture in the utility head as a fluid jet and to cause at least the portion of the resilient tube that extends past the bend to extend in length under force of the pressurized fluid; and d) deactivating the control device to prevent fluid flow to the utility head and to cause the extended portion of the resilient tube to retract to a substantially non-extended, resting state.

15. The method of claim 14, wherein the pressurized fluid flowing through the resilient tube is of a sufficient pressure to create a fluid jet as the fluid exits the at least one aperture of the utility head.

16. The method of claim 14, wherein the pressurized fluid supplied to the utility head is water.

17. The method of claim 14, further comprising repeating the activation and deactivation of the control device.

* * * * *